US006578930B1

(12) United States Patent
Alderman et al.

(10) Patent No.: US 6,578,930 B1
(45) Date of Patent: Jun. 17, 2003

(54) ICE WHEELS

(76) Inventors: Richard L. Alderman, 3062 Artesian La., Madison, WI (US) 53713; Donald C. Hue, 4827 Helgeland Dr., Sun Prarie, WI (US) 53590

( * ) Notice: Subject to any disclaimer, the term of this patent is extended or adjusted under 35 U.S.C. 154(b) by 0 days.

(21) Appl. No.: 10/160,767

(22) Filed: Jun. 3, 2002

(51) Int. Cl.[7] ..... A63C 17/22; A63C 17/18; A63C 17/02; A62K 13/00

(52) U.S. Cl. ..... 301/5.303; 301/5.301; 280/7.13; 280/11.221

(58) Field of Search ..... 301/5.303, 5.301, 301/5.302, 5.1; 280/7.13, 11.221, 841, 600, 11.19

(56) References Cited

U.S. PATENT DOCUMENTS

| | | | | | |
|---|---|---|---|---|---|
| 1,489,197 | A | * | 4/1924 | Daverkosen et al. | 280/11.19 |
| 2,152,684 | A | * | 4/1939 | Grange et al. | 301/5.307 |
| 2,377,366 | A | * | 6/1945 | Paystrup | 280/11.25 |
| 2,448,222 | A | * | 8/1948 | Jones | 301/5.1 |
| 3,907,369 | A | * | 9/1975 | Chevaux | 301/5.301 |
| 4,043,565 | A | * | 8/1977 | Mogannam | 280/11.12 |
| 4,805,934 | A | * | 2/1989 | Mullenax | 280/7.12 |
| 5,259,632 | A | * | 11/1993 | Mahoney | 280/7.14 |
| 5,411,320 | A | * | 5/1995 | Alderman et al. | 301/5.302 |
| 5,901,970 | A | * | 5/1999 | Henshaw | 280/11.19 |
| 5,915,702 | A | * | 6/1999 | Kirschling et al. | 280/11.231 |
| 6,131,923 | A | | 10/2000 | Miotto | |
| 6,182,980 | B1 | | 2/2001 | Smith | |
| 6,290,242 | B1 | | 9/2001 | Ludwig | |
| 6,322,154 | B1 | * | 11/2001 | Alderman et al. | 301/5.303 |

FOREIGN PATENT DOCUMENTS

| | | |
|---|---|---|
| DE | 39995 | 11/1886 |
| GB | 1120895 | 7/1968 |

* cited by examiner

*Primary Examiner*—S. Joseph Morano
*Assistant Examiner*—Long Bao Nguyen

(57) ABSTRACT

The "ICE WHEELS" consists of a wheel assembly, which permits interchange with in-line skate wheels for use on ice that reduces weight and or the rolling resistance on ice while the wheel is perpendicular to the ice. The wheel consists of a lightweight hub, bearing accommodating counterbores and an outer ring containing multiple ice-engaging structures and relief grooves. The ice-engaging structures comprise of an outer circumferential contact means, inner circumferential contact means, a new medial circumferential contact means and multiple support surfaces. A new feature of this invention is the elimination of one or both of the inner circumferential contact means penetration into the ice while the wheel is perpendicular to the ice. This leaves either a flat support surface; a flat support surface with one inner circumferential contact means or two support surfaces with a medial circumferential contact means in between while the wheel is perpendicular to the ice. Reducing the number of ice embedding contact means while the wheel is perpendicular to the ice reduces the rolling resistance of said wheel. Another new feature of this invention is a relief groove that reduces the embedding of the support surface into the ice.

18 Claims, 6 Drawing Sheets

ICE WHEELS

BACKGROUND OF THE INVENTION

The present invention relates to a wheel for use on ice that reduces the weight and rolling resistance of the wheel. Another aspect of this invention provides a low cost hub. Particularly, a wheel especially suited for a conversion of in-line skates, where a conversion to the wheels as described in this invention would permit the use of ice, as a surface medium, for locomotion.

U.S. Pat. No. 6,322,154 to Alderman et al. on Nov. 27, 2001 describes a wheel for use on ice with multiple contact means including one of a smaller diameter on each side for additional lateral friction while pushing off at an angle. Additionally, the width of the support surface in contact with the ice while the skate is perpendicular to the ice is wider than that of a standard ice blade to provide better stability. Said wheels, although providing sufficient lateral friction while minimizing the fracturing of the ice can benefit from the reduced rolling resistance by reducing the number of ice engaging surfaces that embed into the ice to one or none while the wheel is perpendicular to the ice.

U.S. Pat. No. 5,411,320 to Alderman et al. on May 2, 1995 describes a wheel for use on ice with multiple contact means including one of a smaller diameter on each side for additional lateral friction while pushing off at an angle. Additionally, the distance between the contact means engaged in the ice while the skate is perpendicular to the ice is wider than that of a standard ice blade to provide better stability. Said wheels, although providing sufficient lateral friction, unacceptably fracture the ice while executing turns or pushing off and have more than one embedded ice engaging structures while the wheels are perpendicular to the ice.

German Patent No. 39,995 to Schramm et al. on Nov. 9, 1886 describes a convertible roller ice skate that uses either a blade or two concave grooved in-line wheels, per skate, for use on ice. The wheels as described in this patent are single concave grooved wheels that lacks multiple embedded ice engaging structures while the skater is pushing off at an angle and has more than one embedded ice engaging structure while the wheels are perpendicular to the ice.

Great Britain Patent No. 1,120,895 to Makuba N. V. on Jul. 24, 1968 describes a roller ice skate having two or more wheels all of which are arranged one behind the other in a single row. A sharp peripheral ridge enables a push off action to be obtained when skating. This patent describes a wheel that has either two or no embedded ice engaging structures while perpendicular to the ice and lacks multiple embedded ice engaging structures while the skater is pushing off at an angle.

U.S. Pat. No. 1,489,197 to Daverkosen et al. on Apr. 1, 1924 describes a type of ice skate that comprises a roller skate frame, two ball bearing rollers mounted on the front and rear of the frame and each of said rollers being grooved differentially. This patent describes a roller skate with multiple grooves but the wheels lack multiple embedded ice engaging structures while the skater is pushing off at an angle and has more than one embedded ice engaging structure while the wheels are perpendicular to the ice.

U.S. Pat. No. 2,377,366 to Paystrup on Jun. 5, 1945 describes an all-season combination ice and roller skate comprising a foot plate, a single pair of front and rear wheels under said plate, each having a flat felly. A band of the same width as said felly, and a relatively narrower band fitted around the first band and centered thereon, said bands having sharpened outer edges for digging into the ice under tilting of the wheels sideways. The wheel of this patent lacks sufficient friction while it is perpendicular to the ice. These skates, with their squarely sharpened edges, would need to be tilted to about 45 degrees, an angle at which there is little downward force, for the edges to be at an optimum angle for maximum friction. Even less lateral friction for executing tight turns and pushing off at operating angles less than the said 45 degrees. While this patent has no embedded ice engaging structures of the wheel while perpendicular to the ice and multiple embedded ice engaging structures while at an angle it does not provide a support surface when the wheel is at an angle to the ice.

U.S. Pat. No. 4,043,565 to Mogannam on Aug. 23, 1977 describes a recreational device with two blades attached to the front and rear axles of a device similar to a skateboard. The blades are shown as round, oval or being generally polygonal in profile with each side of said polygon being convexly accurate with a thickness that enables concave sharpening. In this patent the wheels lack multiple embedded ice engaging structures while the skater is pushing off at an angle and has more than one embedded ice engaging structure while the wheels are perpendicular to the ice.

U.S. Pat. No. 4,805,934 to Mullenax on Feb. 21, 1989 describe a skateboard with wheels for ice mounted on both sides of the front and rear axle. This patent describes wheels with multiple grooves but the wheels lack multiple embedded ice engaging structures if the wheels are at an angle from perpendicular to the ice and has more than one embedded ice engaging structure while the wheels are perpendicular to the ice.

U.S. Pat. No. 5,259,632 to Mahoney on Nov. 9, 1993 describes a skateboard adapted for use on ice that utilizes a blade assembly comprising of a bushing member, a blade member and a body member. In the embodiment that represents a wheel the disk-shaped blade member is sandwiched by the body member, which encompasses part of the bushing member, leaving a portion of the blade member exposed for contact with the ice. This patent also addresses the adaptation of wheels for use on ice that are mounted on both sides of the front and rear axle. The need for use of a body member as a lightweight structural support for the blade member would be negated by the sufficient strength of the blade member if the blade member were made sufficiently wide so as to provide stability for the in-line ice-skater. This patent describes a wheel that has one embedded ice engaging structure, while the wheel is perpendicular to the ice, lacks multiple embedded ice engaging structures while the skater is pushing off at an angle. A further point is that while the wheel is perpendicular to the ice there is no support structure to prevent it from embedding too far into the ice and thus fracturing the ice unacceptably.

U.S. Pat. No. 5,915,702 to Kirschling et al. on Jun. 29, 1999 describes an in-line skate and wheel for use on ice. This patent has a single circular blade that lacks multiple embedded ice engaging structures edges in contact with the ice when the wheels are at an angle perpendicular to the ice and has more than one embedded ice engaging structure while the wheels are perpendicular to the ice.

U.S. Pat. No. 6,131,923 to Miotto on Oct. 17, 2000 describes a skate with a single rail truck that has a pair of wheels being formed by half bodies, arranged on opposite sides of the rail-shaped frame and means for coupling the half bodies of each wheel to make them rotate together. While this patent allows for ice embedding structures it lacks multiple embedded ice engaging structures while the skater is pushing off at an angle and has more than one embedded ice engaging structure while the wheels are perpendicular to the ice.

U.S. Pat. No. 6,182,980 B1 to Smith on Feb. 6, 2001 describes an in-line skate having tapered metallic wheels for skating on ice surfaces. This patent describes a wheel that lacks multiple embedded ice engaging structures while the skater is pushing off at an angle.

U.S. Pat. No. 6,290,242 B1 to Ludwig on Sep. 18, 2001 describes a two-wheel in-line skate having double-action turning means and dual surfaced wheel rollers. This patent describes a wheel that lacks both multiple embedded ice engaging structures while the skater is pushing off at an angle.

Prior art, while solving the problems of sufficient lateral friction and excessive fracturing of the ice, does not fully address the reduced rolling resistance that this invention solves.

This invention is not disclosed in any one patent or prior art disclosure. Also this invention does not combine one or more prior art patents in order to disclose all the features of this invention. U.S. Pat. No. 1,489,189 (Daverkosen), U.S. Pat. No. 2,377,366 (Paystrup), U.S. Pat. No. 4,043,565 (Mogannam), U.S. Pat. No. 4,805,934 (Mullenax), U.S. Pat. No. 5,259,632 (Mahoney), U.S. Pat. No. 5,411,320 (Alderman et al.), U.S. Pat. No. 5,915,702 (Kirschling et al.), U.S. Pat. No. 6,322,154 (Alderman et al.); Foreign Patents, Germany No. 39,995 (Herm et al.), and British No. 1,120,895 (Makuba N. V.), could not be so combined.

BRIEF SUMMARY OF THE INVENTION

The object of this invention is to provide a wheel that is interchangeable with a standard wheel of a standard in-line skate that reduces the rolling resistance of said wheel when used on ice.

Another objective of this invention is to reduce the weight of the wheels.

An additional object of the invention is to allow for a cost-effective hub that would make the wheels affordable.

To achieve the object of the invention there is a wheel for use on ice comprising a bore and counterbores for an axle and bearings, a hub made of two halves out of a lightweight material, and a removable outer ring containing ice-engaging structures that are substantially harder than ice. The ice-engaging structures comprise of an outer circumferential contact means, inner circumferential contact means, medial circumferential contact means and multiple support surfaces. The outer circumferential contact means, inner circumferential means and medial circumferential contact means are arranged so that at least two contact means are embedded into the ice surface when the wheel is at a predetermined angle from perpendicular to the ice and ice either one contact means is embedded into the ice or no contact means are embedded into the ice when the wheel is perpendicular to the ice. A support surface is directly adjacent to the outer circumferential contact means, adjacent to and between the inner circumferential contact means, on both sides of the medial circumferential contact means and parallel to the ice surface when the wheels are both perpendicular and at a predetermined angle to the ice.

To reduce the rolling resistance of the wheels the number of ice engaging contact means that embed into the ice while the wheel is perpendicular to the ice is reduced from two to one or none.

To improve lateral friction while pushing off and reduce the rolling resistance a relief groove is added adjacent to and between the inner circumferential contact means. This allows for clearance of the support surface so that it does not embed or limits the embedding of the support surface into the ice. By reducing the amount that the support surface embeds into the ice, and therefore the wheel, reduction of both rolling resistance and marking of the ice is obtained.

To reduce the weight of the wheels the hubs are molded in two pieces, preferably of a strong lightweight thermoplastic that can withstand cold temperatures.

Due to the reduction of the number of ice engaging contact means that embed into the ice while the wheel is perpendicular to the ice the rolling resistance is effectively reduced. The new lightweight hubs' cost substantially reduces the total manufacturing cost so that it is affordable for the family ice skating public. Thus we have a wheel that is even more suitable for skating on ice at ice rinks, due to the reduced rolling resistance, weight and marking of the ice.

DETAILED DESCRIPTION OF THE INVENTION

Figure 1:
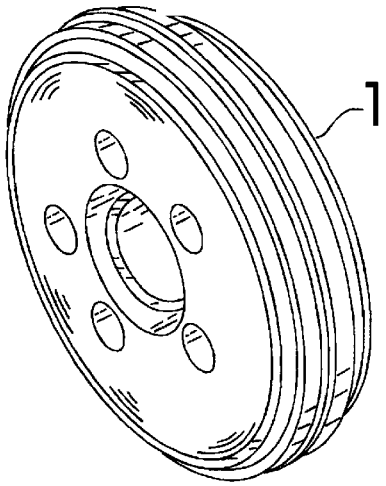
FIG. 1 is an isometric view of the wheel for ice.
Figure 2:
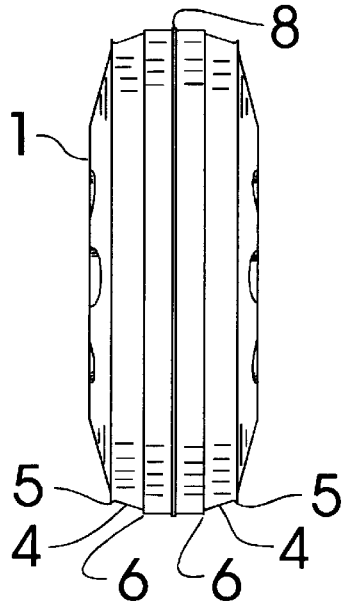
FIG. 2 is a front view of the wheel in FIG. 1 as viewed from a point perpendicular to the center of the axis.
Figure 3:
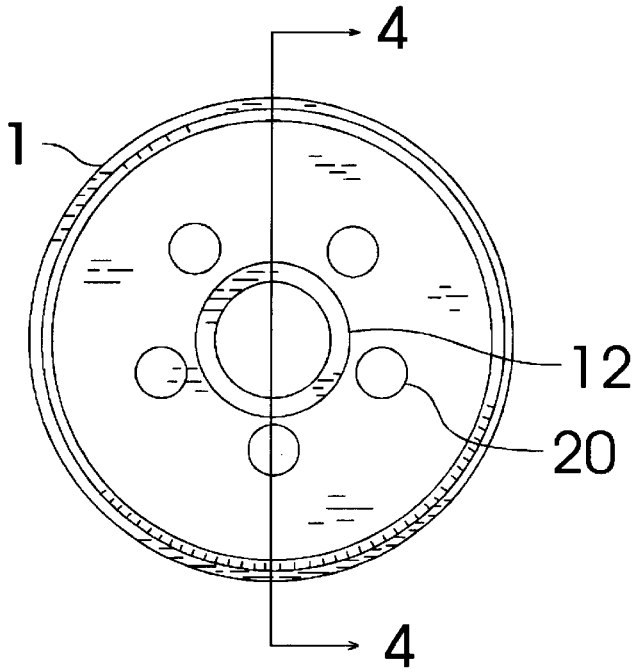
FIG. 3 is a side view of the wheel.
Figure 4:
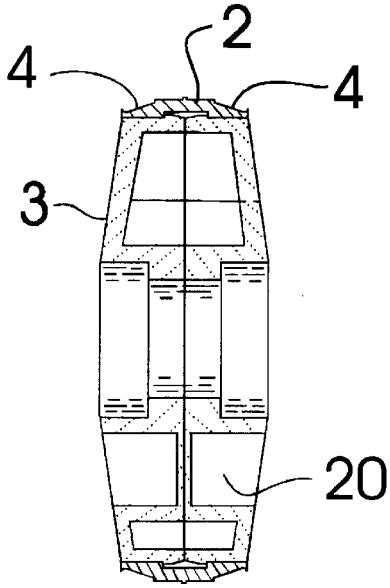
FIG. 4 is a sectional of the wheels a designated "section 4—4" in FIG. 3.
Figure 4A:
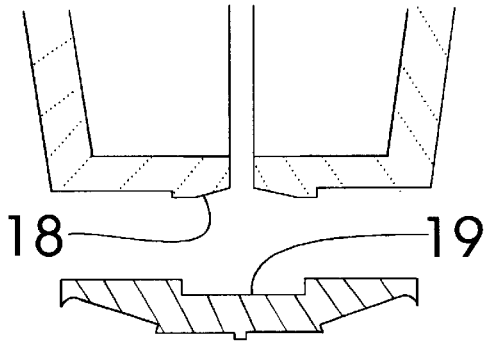
FIG. 4A is an exploded view of the wheel of FIG. 4B showing a detailed view of the mounting structures of the hub halves and the outer contact means ring.
Figure 4B:
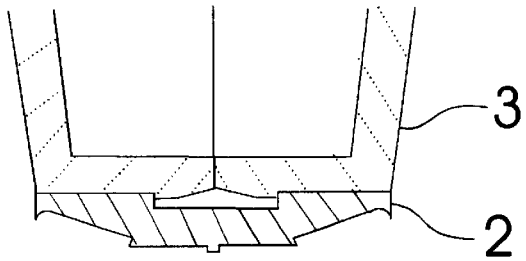
FIG. 4B is a partial enlarged view of the wheel of FIG. 4.
Figure 5:
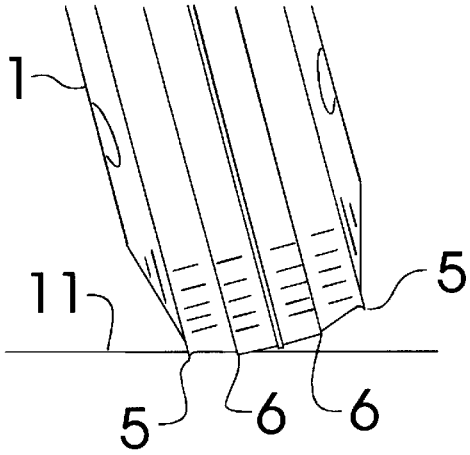
FIG. 5 is an enlarged view showing the wheel embedded in the ice at an angle.
Figure 5A:
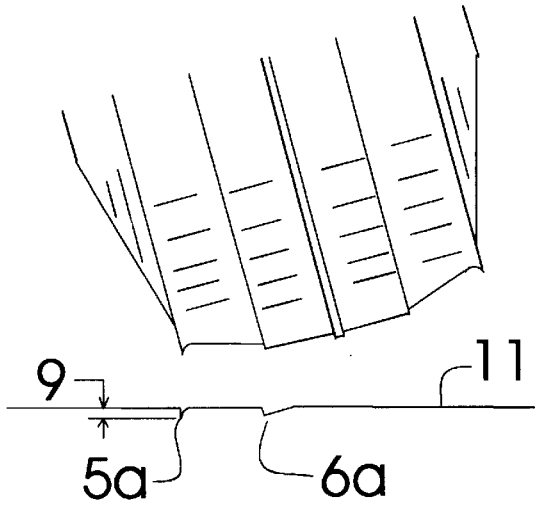
FIG. 5A is a view of the wheel of FIG. 5 showing the resultant grooves from the wheel embedded in the ice.
Figure 5B:
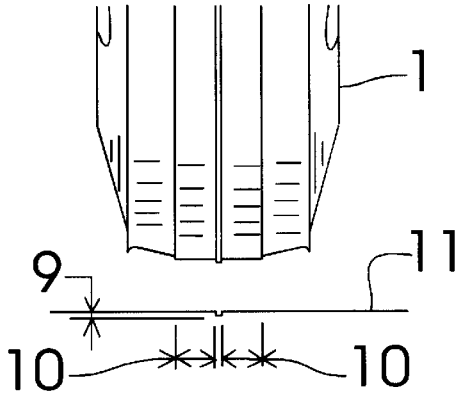
FIG. 5B is an enlarged view showing the wheel that is perpendicular to the ice and showing resultant grooves from the wheel embedded in the ice.
Figure 5C:
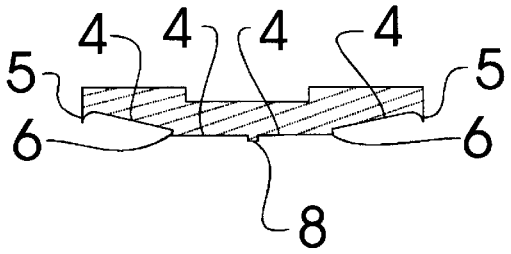
FIG. 5C is a partial enlarged view of the wheel, in FIG. 5B, detailing the ice-engaging structures.
Figure 6:
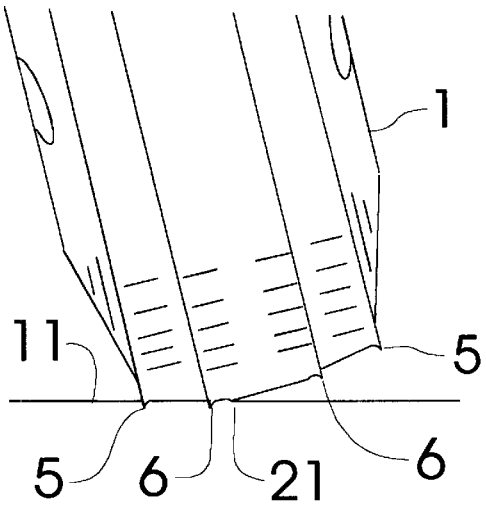
FIG. 6 is an enlarged view showing the wheel embedded in the ice at an angle with another possible configuration of the ice engaging structures including relief grooves.
Figure 6A:
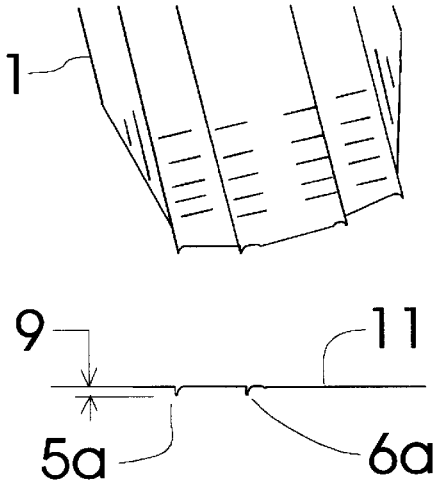
FIG. 6A is a view of the wheel of FIG. 6 showing the resultant grooves from the wheel embedded in the ice.
Figure 6B:
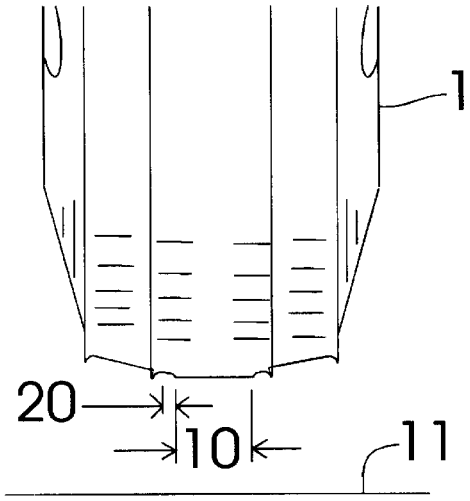
FIG. 6B is an enlarged view showing the wheel that is perpendicular to the ice and showing resultant grooves from the wheel embedded in the ice.
Figure 6C:
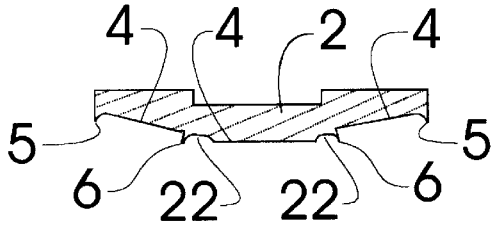
FIG. 6C is a partial enlarged view of the wheel, in FIG. 6B, detailing the ice-engaging structures.
Figure 7:
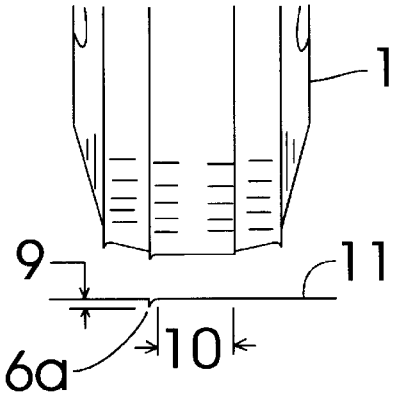
FIG. 7 is an enlarged view of the wheel that is perpendicular to in the ice with yet an another possible configuration of the ice-engaging structures and showing resultant grooves from the wheel embedded in the ice.
Figure 8:
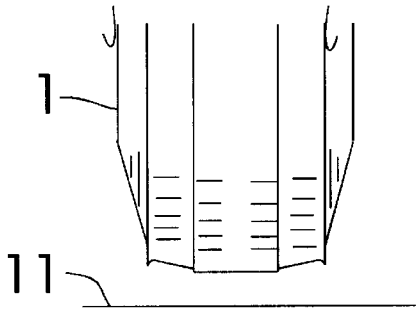
FIG. 8 is an enlarged view of the wheel that is perpendicular to the ice with still an another possible configuration of the ice-engaging structures and showing resultant grooves from the wheel embedded in the ice.
Figure 7A:
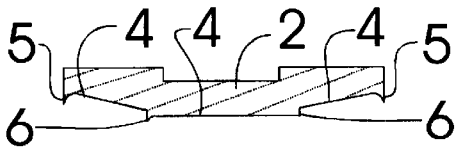
FIG. 7A is a partial enlarged view of the wheel, in FIG. 7, detailing the ice-engaging structures.
Figure 8A:
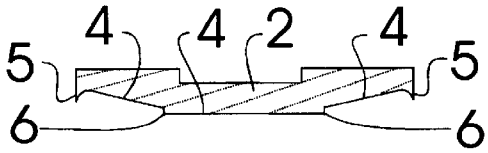
FIG. 8A is an enlarged view of the wheel, in FIG. 8, detailing the ice-engaging structures.
Figure 10:
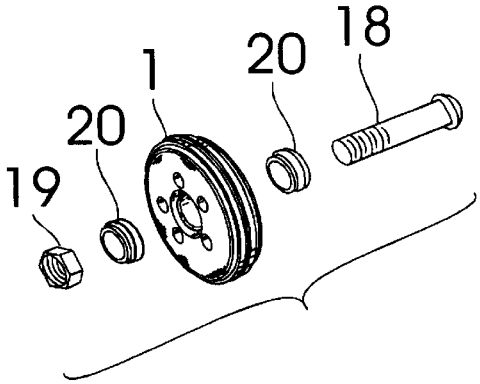
FIG. 10 is an exploded isometric view of the wheel including a typical axle, locknut and bearings.
Figure 9:
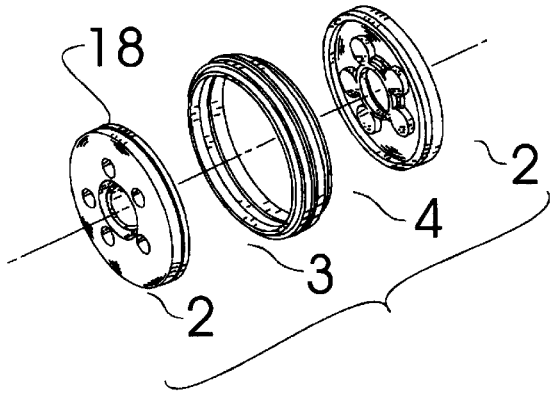
FIG. 9 is an exploded isometric view of the modified wheel showing the two hub halves and the contact
Figure 12:
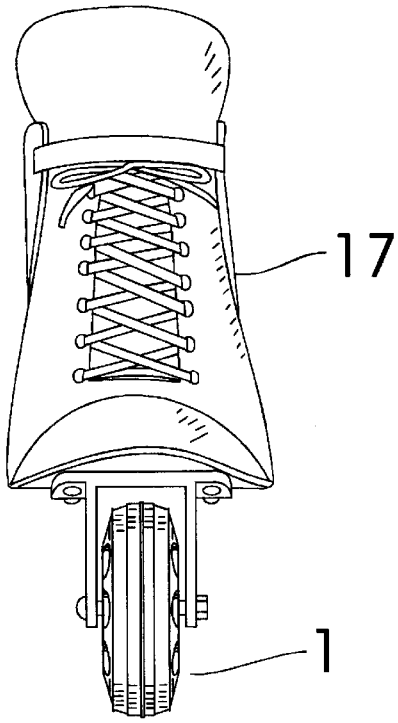
FIG. 12 is a front view of FIG. 11.
Figure 11:
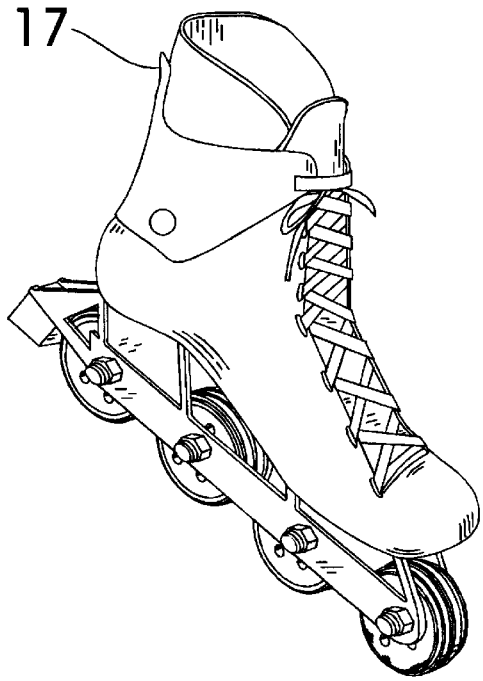
FIG. 11 is an isometric view of a typical in-line skate fitted with the wheels.
Figure 13A:
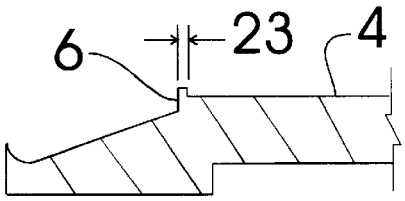
FIG. 13A is an enlarged partial view of FIG. 4 of the outer ring showing the inner circumferential contact means sharpened squarely and raised above the support surface.
Figure 13:
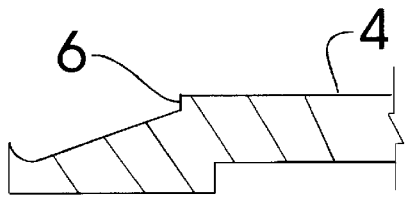
FIG. 13 is an enlarged partial view of FIG. 4 of the outer ring showing the inner circumferential contact means sharpened squarely.
Figure 13C:
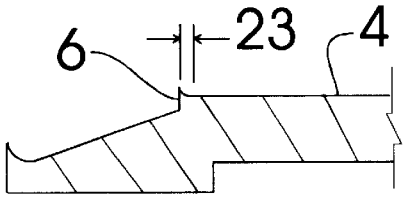
FIG. 13C is an enlarged partial view of FIG. 4 of the outer ring showing the inner circumferential contact means sharpened with a radiused edge and raised above the support surface.
Figure 13B:
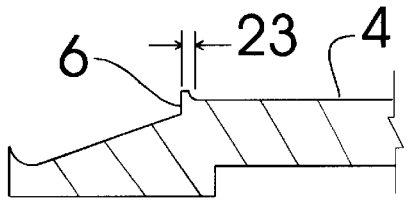
FIG. 13B is an enlarged partial view of FIG. 4 of the outer ring showing the inner circumferential contact means sharpened squarely with a radiused edge and raised above the support surface.
Figure 13E:
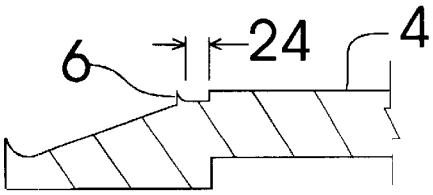
FIG. 13E is an enlarged partial view of FIG. 4 of the outer ring showing the inner circumferential contact means sharpened with a radiused edge and a relief groove is added between the inner circumferential contact means and support surface.
Figure 13D:
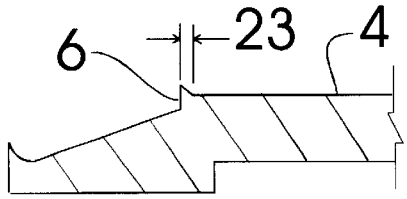
FIG. 13D is an enlarged partial view of FIG. 4 of the outer ring showing the inner circumferential contact means sharpened at an angle and raised above the support surface.

FIG. 1 shows the wheel (1) with an ice-engaging structure consisting of a support surface (4), outer circumferential contact means (5) and inner circumferential contact means (6), see FIG. 2, FIG. 4, FIG. 6A, FIG. 7A, FIG. 8A. The support surface (4) is directly adjacent to the outer circumferential contact means (5), inner circumferential contact means (6) and medial circumferential contact means (8) see FIG. 2, FIG. 4, FIG. 5, FIG. 6A, FIG. 7A and FIG. 8A. The inner circumferential contact means (6), which is configured to not embed into the ice (11) while the wheel (1) is perpendicular to the ice (1), does embed into the ice (11) while the wheel (1) is at a predetermined angle to the ice (11) along with the outer circumferential contact means (5) so that there are two ice engaging structures that embed into the ice (11) and the support surface (4) minimizes the depth of the inner circumferential contact means groove **(6*a*) and the outer circumferential contact means groove (5*a*), see FIG. 5, FIG. 5A and FIG. 13. In FIG. 5B and FIG. 5C a wheel (1) is shown with a modified contact means ring (2), this modification allows for one ice engaging structure that embeds into the ice (11) while the wheel (1) is perpendicular to the ice (11), the ice engaging structure that embeds into the ice is the medial circumferential contact means (8) while the combined width (10) of the two support surfaces (4), adjacent to both sides of the medial circumferential contact means (8), helps to minimize the depth (9) of the medial circumferential contact means groove (8*a*) and the inner circumferential contact means (6), FIG. 13, are configured to not embed into the ice (11) while the wheel (1) is perpendicular to the ice (11). In FIG. 6 and FIG. 6A a support surface (4) is raised to the same diameter as the inner circumferential contact means (6), which the width (10) of prevents the inner circumferential contact means (6) from embedding into the ice (11) while the wheel (1) is perpendicular to the ice (1), but the inner circumferential contact means (6) does embed into the ice (11) while the wheel (1) is at a predetermined angle to the ice (11) along with the outer circumferential contact means (5) so that there are two ice engaging structures that embed into the ice (11) and the support surface (4) minimizes the depth of the inner circumferential contact means groove (6*a*) and the outer circumferential contact means groove (5*a*). A relief groove (22), FIG. 6C and FIG. 13E, adjacent to and between the inner circumferential contact means (6) is of a sufficient width (20), FIG. 13E, so that when the wheel (1) is at a predetermined angle from the ice (11) has no or limited incidental contact (21), FIG. 6, with the ice (11). In FIG. 7 and FIG. 7A a wheel (1) is shown with another modification of the contact means ring (2), this modification allows for one ice engaging structure that embeds into the ice (11) while the wheel (1) is perpendicular to the ice (11), the ice engaging structure that embeds into the ice is the inner circumferential contact means (6) while width (10) of the support surface (4), adjacent to the inner circumferential contact means (6), helps to minimize the depth (9) of the inner circumferential contact means groove (6*a*) and one inner circumferential contact mean (7), FIG. 13C, is configured to not embed into the ice (11) while the wheel (1) is perpendicular to the ice (11). In FIG. 8 and FIG. 8A a wheel (1) is shown with still another modification of the contact means ring (2), this modification allows for no ice engaging structure that embeds into the ice (11) while the wheel (1) is perpendicular to the ice (11), the support surface (4), between the two inner circumferential contact means (7), FIG. 13, which are configured to not embed into the ice (11) while the wheel (1) is perpendicular to the ice (11), acts as a minimally invasive structure that rolls across the ice (11). The inner circumferential contact means (6) are either sharpened squarely, FIG. 13, squarely and raised above the support surface (4), FIG. 13A, sharpened squarely with a radiused edge and raised above the support surface (4), FIG. 13B, sharpened with a radiused edge and raised above the support surface (4), FIG. 13C, or sharpened at an angle and raised above the support surface (4), FIG. 13. In FIG. 13E, the inner circumferential contact means is sharpened with a radiused edge and a relief groove (22) is added between the inner circumferential contact means (6) and the support surface (4). This relief groove (22) reduces the contact of the support surface (4) with the ice (11). The relief groove (22)may be added when the inner circumferential means (6) is sharpened as in FIG. 13A, FIG. 13B, FIG. 13C, FIG. 13D. The contact means ring (2) is held in place to the hub halves (3) with tangs (18) that snap into the snap groove (17) of the outer contact means ring, FIG. 4A, FIG. 4B and FIG. 9. The hub halves (3) may half a series of relief's (19) for esthetics and be made of a moldable substance such as thermoplastics to further reduce the weight and cost. The wheel (1) is attached to a standard in-line boot (13), FIG. 11 and FIG. 12 by a standard axle (14), locknut (15) and bearings (16), FIG. 10, from an in-line skate, by the bearing counterbores (12), FIG. 3**.

What is claimed is:

1. A wheel for use on ice comprising:

a hub and outer ring:

said hub being made of a lightweight material;

said outer ring containing ice-engaging structures;

said ice-engaging structures being made of a material that is substantially harder than ice;

said ice-engaging structures comprising of an outer circumferential contact means, inner circumferential contact means, and support surfaces;

said outer circumferential contact means and inner circumferential contact means being arranged so that at least one contact means is embedded in the ice when the wheel is perpendicular to the ice and two contact means are embedded into the ice when the wheel is at a predetermined angle from perpendicular to the ice;

said support surface is directly adjacent to the outer circumferential contact means and the inner circumferential contact means and is parallel to the ice surface when the outer circumferential contact means and inner circumferential contact means are embedded in the ice at a predetermined angle to the ice;

said support surface is between the inner circumferential contact means and is parallel to the ice surface when the wheel is perpendicular to the ice;

said support surface being of a width that is sufficient to minimize the penetration of the ice engaging structures that embed into the ice.

2. A wheel for use on ice comprising:

a hub and outer ring:

said hub being made of a lightweight material;

said outer ring containing ice-engaging structures;

said ice-engaging structures being made of a material that is substantially harder than ice;

said ice-engaging structures comprising of an outer circumferential contact means, inner circumferential contact means, support surfaces and a medial circumferential contact means;

said outer circumferential contact means, inner circumferential contact means and medial circumferential contact means being arranged so that only the medial circumferential contact means is embedded into the ice surface when the wheel is perpendicular to the ice and two contact means embedded into the ice when the wheel is at a predetermined angle from perpendicular to the ice;

said support surface is directly adjacent to the outer circumferential contact means and the inner circumferential contact means and is parallel to the ice surface when the outer circumferential contact means and inner circumferential contact means are embedded in the ice at a predetermined angle to the ice;

said support surface is adjacent to both sides of the medial circumferential contact means and is parallel to the ice surface when the wheel is perpendicular to the ice;

said support surface being of a width that is sufficient to minimize the penetration of the ice engaging structures that embed into the ice.

3. A wheel for use on ice comprising:

a hub and outer ring:

said hub being made of a lightweight material;

said outer ring containing ice-engaging structures;

said ice-engaging structures being made of a material that is substantially harder than ice;

said ice-engaging structures comprising of an outer circumferential contact means, inner circumferential contact means and support surfaces;

said outer circumferential contact means and inner circumferential contact means being arranged so that no contact means are embedded into the ice when the wheel is perpendicular to the ice and two contact means are embedded into the ice when the wheel is at a predetermined angle from perpendicular to the ice;

said support surface is directly adjacent to the outer circumferential contact means and the inner circumferential contact means and is parallel to the ice surface when the outer circumferential contact means and inner circumferential contact means are embedded in the ice at a predetermined angle to the ice;

said support surface is between the inner circumferential contact means and is parallel to the ice surface when the wheel is perpendicular to the ice;

said support surface being of a width that is sufficient to minimize the penetration of the ice engaging structures that embed into the ice.

4. The wheel of claim 1, wherein said wheel has a relief groove both adjacent to and between the inner circumferential contact means:

said relief groove is wide enough to minimize the support surface, between the inner circumferential contact means, from embedding into the ice while the wheel is at a predetermined angle from perpendicular to the ice.

5. The wheel of claim 2, wherein said wheel has a relief groove both adjacent to and between the inner circumferential contact means:

said relief groove is wide enough to minimize the support surface, between the inner circumferential contact means, from embedding into the ice while the wheel is at a predetermined angle from perpendicular to the ice.

6. The wheel of claim 3, wherein said wheel has a relief groove both adjacent to and between the inner circumferential contact means:

said relief groove is wide enough to minimize the support surface, between the inner circumferential contact means, from embedding into the ice while the wheel is at a predetermined angle from perpendicular to the ice.

7. The wheel of claim 1, wherein said hub further comprises a bore and counterbore, on each side, to accommodate an axle and bearings:

said hub further comprises two halves that are molded preferably of a strong lightweight thermoplastic that can withstand cold temperatures.

8. The wheel of claim 2, wherein said hub further comprises a bore and counterbore, on each side, to accommodate an axle and bearings:

said hub further comprises two halves that are molded preferably of a strong lightweight thermoplastic that can withstand cold temperatures.

9. The wheel of claim 3, wherein said hub further comprises a bore and counterbore, on each side, to accommodate an axle and bearings:

said hub further comprises two halves that are molded preferably of a strong lightweight thermoplastic that can withstand cold temperatures.

10. The wheel of claim 4, wherein said hub further comprises a bore and counterbore, on each side, to accommodate an axle and bearings:

said hub further comprises two halves that are molded preferably of a strong lightweight thermoplastic that can withstand cold temperatures.

11. The wheel of claim 5, wherein said hub further comprises a bore and counterbore, on each side, to accommodate an axle and bearings:

said hub further comprises two halves that are molded preferably of a strong lightweight thermoplastic that can withstand cold temperatures.

12. The wheel of claim 6, wherein said hub further comprises a bore and counterbore, on each side, to accommodate an axle and bearings:

said hub further comprises two halves that are molded preferably of a strong lightweight thermoplastic that can withstand cold temperatures.

13. The wheel of claim 1, wherein said wheel is interchangeable with a standard wheel of a standard in-line skate.

14. The wheel of claim 2, wherein said wheel is interchangeable with a standard wheel of a standard in-line skate.

15. The wheel of claim 3, wherein said wheel is interchangeable with a standard wheel of a standard in-line skate.

16. The wheel of claim 4, wherein said wheel is interchangeable with a standard wheel of a standard in-line skate.

17. The wheel of claim 5, wherein said wheel is interchangeable with a standard wheel of a standard in-line skate.

18. The wheel of claim 6, wherein said wheel is interchangeable with a standard wheel of a standard in-line skate.

* * * * *